US007207902B1

(12) United States Patent
Hamlin

(10) Patent No.: US 7,207,902 B1
(45) Date of Patent: Apr. 24, 2007

(54) METHOD AND APPARATUS FOR LOCATING AND RECORDING THE POSITION OF A GOLF BALL DURING A GOLF GAME

(76) Inventor: Thomas B Hamlin, 17545 Kelok Rd., Lake Oswego, OR (US) 97034

( * ) Notice: Subject to any disclaimer, the term of this patent is extended or adjusted under 35 U.S.C. 154(b) by 196 days.

(21) Appl. No.: 11/005,432

(22) Filed: Dec. 6, 2004

(51) Int. Cl.
*A63B 43/00* (2006.01)

(52) U.S. Cl. ..... 473/353

(58) Field of Classification Search ..... 473/200, 473/353, 407, 570, 571
See application file for complete search history.

(56) References Cited

U.S. PATENT DOCUMENTS

| | | | | |
|---|---|---|---|---|
| 1,620,290 | A | 3/1927 | Rubin | |
| 3,782,730 | A | 1/1974 | Horchler | |
| 4,614,340 | A | 9/1986 | Hosoya | |
| 4,660,039 | A | 4/1987 | Barricks et al. | |
| 4,961,575 | A | 10/1990 | Perry | |
| 5,447,314 | A | 9/1995 | Yamazaki et al. | |
| 5,507,485 | A | 4/1996 | Fisher | |
| 5,626,531 | A | 5/1997 | Little | |
| 5,662,533 | A | 9/1997 | Chadwell | |
| 5,662,534 | A | 9/1997 | Kroll | |
| 5,743,815 | A | 4/1998 | Helderman | |
| 5,910,057 | A | 6/1999 | Quimby et al. | |
| 6,113,504 | A | 9/2000 | Kuesters | |
| 6,456,938 | B1 | 9/2002 | Barnard | |
| 6,524,199 | B2 | 2/2003 | Goldman | |
| 2003/0191547 | A1* | 10/2003 | Morse | 700/91 |
| 2005/0101411 | A1* | 5/2005 | Stiller et al. | 473/353 |

FOREIGN PATENT DOCUMENTS

| | | |
|---|---|---|
| FR | 2.616.335 | 12/1988 |

* cited by examiner

*Primary Examiner*—Kim Nguyen
(74) *Attorney, Agent, or Firm*—Michael I Kroll

(57) ABSTRACT

An apparatus for locating a golf ball during play of a golf game includes a golf ball having a passive transmitter and a mechanism for sensing environmental conditions positioned therein. The apparatus further includes a mechanism for determining and providing a location of the golf ball. A hand-held unit is further provided. The hand held unit includes a mechanism for enabling at least one of the passive transmitter and the environmental sensing mechanism contained within the golf ball. A receiver is contained within the hand-held unit for receiving a location signal from the determining and providing mechanisms. A mechanism positioned on the hand-held unit for indicating to a golfer the location of the golf ball. Upon the location being indicated, the environmental sensing mechanism is able to selectively determine conditions corresponding to the location and provide the conditions to the hand-held unit for further indication to golfer.

18 Claims, 9 Drawing Sheets

METHOD AND APPARATUS FOR LOCATING AND RECORDING THE POSITION OF A GOLF BALL DURING A GOLF GAME

BACKGROUND OF THE INVENTION

1. Field of the Invention

The present invention relates generally to golf equipment and, more specifically, to a golf ball having a pressure sensor, passive transmitter and a hand-held data acquisition and locator device containing an interactive information system application with a data transfer port.

The hand-held device locator function is used to determine the location of a target golf ball using an LED that increases in frequency indicating the location of the golf ball relative to the locator device. The handheld unit may also contain an audio component that changes in frequency as the locator device approaches the target ball.

The hand-held device is further used to download GPS data regarding the location of each tee and cup for each hole of a predetermined golf course and receive GPS data on demand to record the position of a ball during play and display the remaining yardage to the cup. The number of strokes per hole can additionally be entered during the course of play and displayed in the yardage display by toggling a switch from the yardage display to the stroke display.

The pressure sensor in the target golf ball is used to sense the surroundings of the ball upon landing. The pressure sensor is able to selectively determine the conditions surrounding the ball. This includes but is not limited to mud, dry sand, wet sand, water or dirt. Upon detecting the existing condition, this information is transmitted to a central processor. The environmental information along with the location of the ball is compiled to give an accurate real-time description of the conditions of the course. This real-time condition description can then be transmitted to other golfers in order for them to play accordingly.

The hand held device is further used to aid the golfer in club selection depending on the conditions surrounding the ball. It will indicate to the golfer what he used in prior similar conditions before and the success rate in that situation.

Furthermore the hand-held device has a universal serial bus (USB) port that provides for the downloading of information regarding a specific golf course, as aforementioned, as well as the ability to transfer all data acquired during a golf game to an external computer component for further processing. The supplied data may also be uploaded to a software program for tracking one's handicap, to an internet website or to hardware in a golf course clubhouse for monitoring tournaments, outings and the like. Since tournament use will require a large number of people to use the present invention simultaneously on the same course a means for ball and player differentiation must be included. Each ball in a sleeve could have a numbered chip embedded therein and the transmitter would have a bar code scanner included therein to scan the bar code on the box of the sleeve prior to going into play in order to read the embedded code and will then on recognize only that specific code until the next ball is activated and a penalty stroke is automatically added to the stroke counter.

The hand-held device may also have a removable memory card similar to those used in digital cameras to provide for greater data storage capability and an increased ease of transferring data to other applications.

2. Description of the Prior Art

There are other locator devices designed for tracking golf balls during play. Typical of these is U.S. Pat. No. 1,620,290 issued to Rubin on Mar. 8, 1927. Another patent was issued to Horchler on Jan. 1, 1974 as U.S. Pat. No. 3,782,730. Yet another U.S. Pat. No. 4,614,340 was issued to Hosoya on Sep. 30, 1986 and still yet another was issued on Apr. 21, 1987 to Barricks et al. as U.S. Pat. No. 4,660,039.

Another patent was issued to Yamazaki et al. on Sep. 5, 1995 as U.S. Pat. No. 5,447,314. Yet another U.S. Pat. No. 5,626,531 was issued to Little on May 6, 1997. Another was issued to Chadwell on Sep. 2, 1997 as U.S. Pat. No. 5,662,533 and still yet another was issued on Sep. 2, 1997 to Kroll et al. as U.S. Pat. No. 5,662,534.

Another patent was issued to Helderman on Apr. 28, 1998 as U.S. Pat. No. 5,743,815. Yet another U.S. Pat. No. 5,910,057 was issued to Quimby et al. on Jun. 8, 1999. Another was issued to Kuesters on Sep. 5, 2000 as U.S. Pat. No. 6,113,504 and still yet another was issued on Dec. 16, 1988 to Sonigo as U.S. patent No. FR2616335.

U.S. Pat. No. 1,620,290

Inventor: Adolph J. Rubin

Issued: Mar. 8, 1927

The invention is a golf ball having embedded at its center a signal device. The ball is comprised of a tight casing having a spring connected to the casing at one end and to a shaft at the other. The shaft extends at one end through the wall of the casing and is provided with a squared end to receive a winding key which is inserted through a radial tube or passage in the ball.

U.S. Pat. No. 3,782,730

Inventor: Stephen Alexander Horchler

Issued: Jan. 1, 1974

The invention relates to an electronic golf ball comprising a central resilient sphere, a mass of elastic material surrounding the sphere and an outer casing, the central sphere including an electric squegging oscillator circuit, a battery therefor and a transmitting coil, all enclosed in a spherical mass of a set resin which forms a solid core, the spherical mass being located with close fit in a hollow spherical cavity formed in the central resilient sphere. The battery is a mercury cell located within the transmitting coil, as are the other components of the squegging oscillator circuit. The electric circuit may include components which permit the oscillator to be turned on and off when the golf ball is brought into and then moved out of an A.C. magnetic field having a predetermined frequency.

U.S. Pat. No. 4,614,340

Inventor: Fumio Hosoya

Issued: Sep. 30, 1986

According to the invention, a smoke emission device such as a golf ball or a baseball game ball which emits attractive smoke while flying is provided for entertainment display. The smoke emission device includes a central core of a detonator material, a layer of a smoke emitting material and an outer shell having apertures for allowing the smoke to pass therethrough. A wire net between 100 and 10 mesh is interposed between the outer shell and the layer of the smoke emitting material to cover at least the apertures to thereby prevent hot molten mass of the combustion product from spilling out of the apertures.

U.S. Pat. No. 4,660,039

Inventor: Mary S. Barricks et al.

Issued: Apr. 21, 1987

A locating system for sport objects where the user carries an r.f. transmitter, and the sport object has a conductive stripe thereon which increases the load on the transmitter as it moves closer to the sport object. The conductive stripe has an effective length of one-quarter wavelengths at the signal frequency to act as a tuned antenna.

U.S. Pat. No. 5,447,314

Inventor: Tsuyoshi Yamazaki et al.

Issued: Sep. 5, 1995

A sound emitting golf ball is provided for locating a golf ball after it is struck by a golf club. The system comprises a miniaturized electronic, battery powered piezoelectric sound generator surrounded by a shock absorber that is embedded inside a golf ball. The sound generating system is constructed with very small, inexpensive shock resistant components and embedded at the center of the golf ball inside the shock absorber. The system can be designed to operate in the audible or ultrasonic range.

U.S. Pat. No. 5,626,531

Inventor: Phillip L. Little

Issued: May 6, 1997

Golf balls have a passive tag at selected capacitance inserted within their interior, to enable detection of the presence of the tag, and of the ball, using an electronic detecting system. The tags are passive, being energized into emitting a signal by the presence of a detector field of predetermined characteristics such that the tag generates a responsive signal, which can be detected by an adjacent detector circuit, to signal the presence of a tagged ball. One field of use is for driving ranges, where the unauthorized removal of range balls constitutes an unacceptable loss for the proprietors of the establishment. The system also lends itself to finding lost balls, using a hand-portable detector, and to use with other types of game ball.

U.S. Pat. No. 5,662,533

Inventor: Donald Chadwell

Issued: Sep. 2, 1997

A golf ball locating apparatus and a method of applying a reflective coating to the golf ball. The apparatus involves a handheld apparatus which locates a wayward golf ball and identifies its relative position to the handheld apparatus. The handheld apparatus is structured in two preferred embodiments: the first is a handheld apparatus that fits into a user's pocket; the second is a shaft arrangement which has two extendable wings to form a "T" shape. The pocket sized embodiment has a forward facing window to direct a beam from the apparatus. The beam of radiation reacts with a clear coating on the golf ball and is sensed by the apparatus which then illustrates, via a display, the relative location of the golf ball. The "T" embodiment has antennas embedded into the wings which emit a field which are disturbed by the coating on the golf ball; lights associated with the antennas are illuminated to show the operator which antenna is in the closest proximity to the golf ball. The coating on the golf-ball is applied through a variety of techniques and preferably covers the entirety of the golf ball. One methodology uses an impregnated cloth to wipe the golf ball immediately prior to placing the ball in-play. This assures a coating on the golf ball during each play.

U.S. Pat. No. 5,662,534

Inventor: Braden W. Kroll et al.

Issued: Sep. 2, 1997

A system and method for locating lost golf balls is taught. The system includes a special golf ball with an octant corner reflector resident within the center of the golf ball, as well as a convenient flashlight sized radar transmitter and receiver. The method teaches the use of such a portable handheld radar transmitter and receiver to sweep a golf course for evidence of an echo from the special golf ball with a resident reflector.

U.S. Pat. No. 5,743,815

Inventor: Michael D. Helderman

Issued: Apr. 28, 1998

An electronically identifiable golf ball having a passive transponder implanted therein. The transponder is surrounded by a layer of elastic material which is then surrounded by a rigid housing to protect the passive transponder from the external forces applied to the golf ball.

U.S. Pat. No. 5,910,057

Inventor: Robert W. Quimby et al.

Issued: Jun. 8, 1999

A new Golf Ball Distance and Locating System for determining the distance a golf ball was driven and for locating the golf ball within difficult to locate terrain. The inventive device includes a transmitter concentrically positioned within the golf ball, a receiver for determining distance and direction of the golf ball from a golfer. The transmitter is surrounded by an impermeable encasement which is positioned within a protective gel contained by a gel container for reducing shock impact from striking the golf ball thereby reducing the chance of damage to the transmitter. The gel container is positioned within a viscous liquid concentrically filling the golf ball thereby providing additional protection for the transmitter from the shock impact. The transmitter emits a high frequency signal which is detected by the receiver which thereafter determines the distance from the receiver and the direction of the golf ball in relation to a projected direction of the receiver.

U.S. Pat. No. 6,113,504

Inventor: Eckhard H. Kuesters

Issued: Sep. 5, 2000

A golf ball locator system. The golf ball comprises a transmitter that transmits a coded signal, identifying the ball, and that is received by an array of receivers. The receivers measure either the angle of arrival, or the time of arrival of the signal, which is transmitted to a processor that uses triangulation calculations to generate location coordinates of the golf ball. The processor then transmits the location coordinates to a display unit. The display unit can be portable and viewed by the golfer. The display unit can simply display golf ball position coordinates in relation to a pre-existing golf course map, or display the golf ball on a map which may include various landmarks of the golf course. The system can further include a player location device that allows the system to give audio or visual traveling instructions to assist the golfer to locate his/her ball.

French Patent Number FR2616335

Inventor: Ariel Sonigo

Issued: Jun. 11, 1987

The invention relates to a golf ball including a location device. This location device essentially comprises an emitter 5 of electromagnetic waves incorporated in the central sphere of the golf ball and equipped with an independent supply 4 so that the ball may be located by means of a suitable receiver. The invention makes it possible to easily find golf balls lost during a round.

While these golf locator devices may be suitable for the purposes for which they were designed, they would not be as suitable for the purposes of the present invention, as hereinafter described.

SUMMARY OF THE PRESENT INVENTION

The present invention relates generally to golf equipment and, more specifically, to a golf ball having a pressure sensor, passive transmitter and a hand-held data acquisition and locator device containing an interactive information system application with a data transfer port.

The hand-held device locator function is used to determine the location of a target golf ball using an LED that increases in frequency indicating the location of the golf ball relative to the locator device. The handheld unit may also contain an audio component that changes in frequency as the locator device approaches the target ball.

The hand-held device is further used to download GPS data regarding the location of each tee and cup for each hole of a predetermined golf course and receive GPS data on demand to record the position of a ball during play and display the remaining yardage to the cup. The number of strokes per hole can additionally be entered during the course of play and displayed in the yardage display by toggling a switch from the yardage display to the stroke display.

The pressure sensor in the target golf ball is used to sense the surroundings of the ball upon landing. The pressure sensor is able to selectively determine the conditions surrounding the ball. This includes but is not limited to mud, dry sand, wet sand, water or dirt. Upon detecting the existing condition, this information is transmitted to a central processor. The environmental information along with the location of the ball is compiled to give an accurate real-time description of the conditions of the course. This real-time condition description can then be transmitted to other golfers in order for them to play accordingly.

The hand held device is further used to aid the golfer in club selection depending on the conditions surrounding the ball. It will indicate to the golfer what he used in prior similar conditions before and the success rate in that situation.

Furthermore the hand-held device has a universal serial bus (USB) port that provides for the downloading of information regarding a specific golf course, as aforementioned, as well as the ability to transfer all data acquired during a golf game to an external computer component for further processing. The supplied data may also be uploaded to a software program for tracking one's handicap, to an internet website or to hardware in a golf course clubhouse for monitoring tournaments, outings and the like. Since tournament use will require a large number of people to use the present invention simultaneously on the same course a means for ball and player differentiation must be included. Each ball in a sleeve could have a numbered chip embedded therein and the transmitter would have a bar code scanner included therein to scan the bar code on the box of the sleeve prior to going into play in order to read the embedded code and will then on recognize only that specific code until the next ball is activated and a penalty stroke is automatically added to the stroke counter.

The hand-held device may also have a removable memory card similar to those used in digital cameras to provide for greater data storage capability and an increased ease of transferring data to other applications.

A primary object of the present invention is to provide a device for locating and recording a golf ball during ball of a golf game.

Another object of the present invention is to provide a golf ball having a passive transmitter contained therein.

Yet another object of the present invention is to provide a hand-held data acquisition and locator device.

Still yet another object of the present invention is to provide a hand-held data acquisition and locator device having a transponder.

A further object of the present invention is to provide a hand-held data acquisition and locator device capable of emitting a frequency modulated signal causing the golf ball transmitter to emit a frequency modulated signal.

A yet further object of the present invention is to provide a hand-held data acquisition and locator device capable of receiving a frequency modulated signal from the aforementioned transmitting golf ball.

A still yet further object of the present invention is to provide a hand-held data acquisition and locator device having an audio component and/or illumination component that emits a variable signal in response to the distance between the passive transmitting golf ball and the hand-held locator device.

Another object of the present invention is to provide a hand-held data acquisition and locator device having a reception component.

Yet another object of the present invention is to provide a hand-held data acquisition and locator device having a reception component that receives and records information from the global positioning satellite system.

Still yet another object of the present invention is to provide a data acquisition and locator device having a universal serial bus (USB) port for data transfer.

A further object of the present invention is to provide a data acquisition and locator device having a memory component for storing GPS system information specific to each geographic location of each tee box and cup for each hole for a predetermined golf course.

A yet further object of the present invention is to provide a data acquisition and locator device having a numerical processor component for calculating and displaying the yardage for each hole.

A still further object of the present invention is to provide a hand-held data acquisition and locator device having a data entry component for designating the display of the yardage from the tee to the flag stick for any hole of the aforementioned golf course.

Another object of the present invention is to provide a hand-held data acquisition and locator device capable of receiving and recording information from the GPS system upon demand of the geographic location of the requesting hand-held device indicating the location of a ball in play.

Yet another object of the present invention is to record the location of a ball in play by engaging a GPS locator session while the hand-held locator device is in close proximity to the said ball in play.

Still yet another object of the present invention is to provide a hand-held data acquisition and locator device capable of receiving and recording information from the GPS system at the point of a ball in play, calculating the remaining distance to the cup and displaying the same in yardage.

Another object of the present invention is to provide a golf ball with a pressure sensor for selectively determining information regarding the ball's surroundings.

Yet another object of the present invention is to transmit the surrounding pressure information to a central processor.

Still another object of the present invention is to collate the pressure information and the ball location information, which translates into real-time course conditions.

Another object of the present invention is to determine based on the sensed pressure information whether the ball landed on at least one of dry sand, wet sand, water, dry dirt, mud, grass, high grass, low grass, wet grass and dry grass.

Yet another object of the present invention is to provide the real-time course condition information to other golfers.

A further object of the present invention is to provide a hand-held device that indicates to the player the type of club previously used with that pressure condition.

Another object of the present invention is to provide a hand-held device that indicates to the player the previous success rate of using a particular club with a particular pressure condition.

Additional objects of the present invention will appear as the description proceeds.

The present invention overcomes the shortcomings of the prior art by providing a method and apparatus for locating and recording a golf ball during a golf game as well as for determining the golf course conditions and appropriate clubs for use in said conditions. The golf ball has a passive transmitter. A hand-held locator device is used to locate the ball when hit to an area with an obscured view. An additional element is provided wherein the hand-held device is further used to download GPS data regarding the location of each tee and cup for each hole of a predetermined golf course and receive GPS data on demand to record the position of a ball during play and display the remaining yardage to the cup. The number of strokes per hole can additionally be entered and displayed during the course of play.

Another additional element is that the golf ball has a pressure sensor to determine the ball surroundings. A central processor compiles the sensed pressure information and the ball location to create a real-time course condition model. This information could then be obtained by other golfers.

An additional element is provided wherein the hand held device is further used to indicate to the player what type of club he used in previous similar conditions and the success rate of using that club.

Furthermore the hand-held device has a universal serial bus (USB) port and/or a removable memory card similar to those used in digital cameras that provides for the downloading of information regarding a specific golf course, as aforementioned, as well as the ability to transfer all data acquired during a golf game to an external computer component for further processing such as uploading to a software program for tracking one's handicap or to an internet website.

The foregoing and other objects and advantages will appear from the description to follow. In the description, reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

DESCRIPTION OF THE REFERENCED NUMERALS

Turning now descriptively to the drawings, in which similar reference characters denote similar elements throughout the several views, the Figures illustrate the golf ball locator device of the present invention. With regard to the reference numerals used, the following numbering is used throughout the various drawing figures.

10 golf ball locator device
12 golf ball
14 passive transmitter
15 signal
16 hand-held unit
18 visual alert
20 audio alert
22 hand-held unit receiver
24 hand-held unit transmitter
26 housing
28 yardage display
30 mute button
32 USB port
33 removable memory card
34 charging port
35 yardage transfer switch
36 locator power switch
38 memory
40 microprocessor
42 power source
44 global positioning satellite
46 geographic information receiver

48 global positioning satellite transmitter
50 golfer
54 hand held unit signal
56 frequency modulated signal
58 geographic information transmission
62 sound
64 method of locating the golf ball of the present invention.
66 pressure sensor
68 mud
70 transmission from 66
72 central processor
74 transmission from 72 to 16
76 club display
78 success rate display
80 transmission from 44 to 72

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

Figure 1:
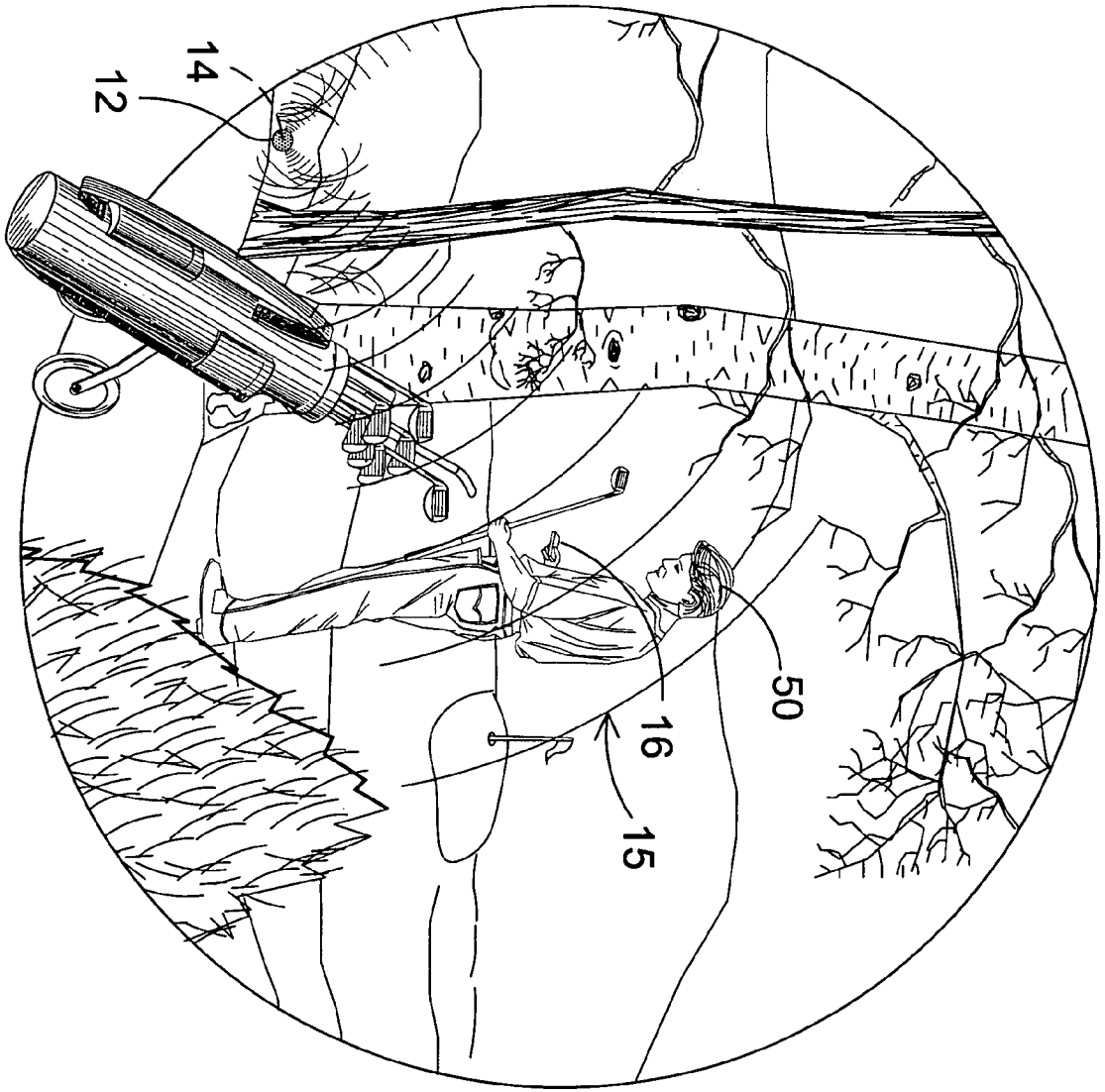
FIG. 1 is an illustrative view of the present invention in use.

The following discussion describes in detail one embodiment of the invention (and several variations of that embodiment). This discussion should not be construed, however, as limiting the invention to those particular embodiments, as practitioners skilled in the art will recognize numerous other embodiments as well. For definition of the complete scope of the invention the reader is directed to appended claims.

Turning now descriptively to the drawings, in which similar reference characters denote similar elements throughout the several views, FIGS. 1 through 9 illustrate the golf ball locator device of the present invention which is indicated generally by the numeral 10.

FIG. 1 is the present invention of a golf ball locator device 10 having a passive chip 14 situated within the ball 12 that responds to a locator signal 24 transmitted from a hand-held locator unit 16 to inform a golfer 50 if he is approaching the ball 12 and provides visual and audible indicators 60,62 that increase in intensity as the distance decreases.

The golf ball locator device 10 is shown illustratively in FIG. 1. Shown herein, a golfer 50 is using his hand-held locator unit 16 to locate his errant golf ball 12. In response, the passive transmitter 14 located within golf ball 12 emits a signal 15 that is received by the transmitter 24 of the hand-held unit 16. As the golfer 50 moves close the signal 15 emitted by the passive transmitter 14 becomes stronger thereby causing an audio alert 20 emitted by the hand-held unit transmitter signal 24 to increase in volume. Additionally, a visual alert 18 emitted by the hand-held unit transmitter signal 24 flashes with a greater intensity as the strength of the signal 15 emitted by the passive transmitter increases.

Figure 2:
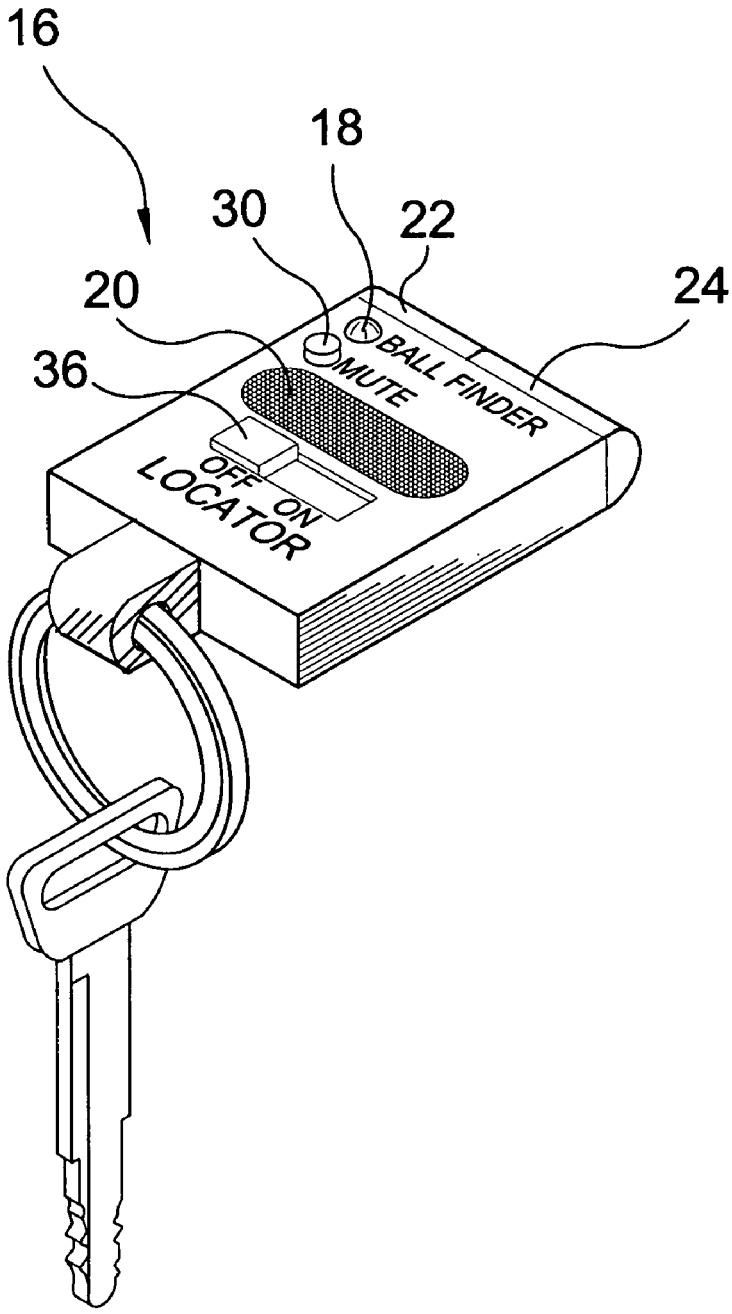
FIG. 2 is perspective view of the hand-held locator unit of the present invention.

FIG. 2 is a perspective view of the hand-held unit 16 of the present invention. The unit 16 comprises a housing 26, a visual locator 18, an audible locator 20 and a mute button 30 for the audible locator 20 for when it might prove to be a distraction to others. Further included is a switch 36 to activate and deactivate the transmitter 14 and the receiver 22 that accepts signals emitted by the passive chip 14 in the golf ball 12.

A perspective view of one embodiment of the hand-held unit 16 of the golf ball locator device 10 of the present invention is shown in FIG. 2. The hand-held unit 16 has a first end and a second end. The first end of hand-held unit 16 includes a key ring. The second end of hand-held unit 16 comprises a hand-held unit transmitter 24 and a hand-held unit receiver 22. The hand-held unit 16 has a locator power switch 36 to activate and deactivate the passive transmitter 14 located in the golf ball 12. The receiver 22 receives the signal 15 emitted by the passive transmitter 14 in golf ball 12. Located on hand-held unit 16 is a visual alert 18, which increases the flashing intensity as the hand-held unit 16 approaches golf ball 12. The hand-held unit 16 further includes the audio alert 20, which becomes louder as hand-held unit 16 approaches golf ball 12. Hand-held unit 16 also has a mute button 30 to prevent the audio component 20 from distracting others.

Figure 3:
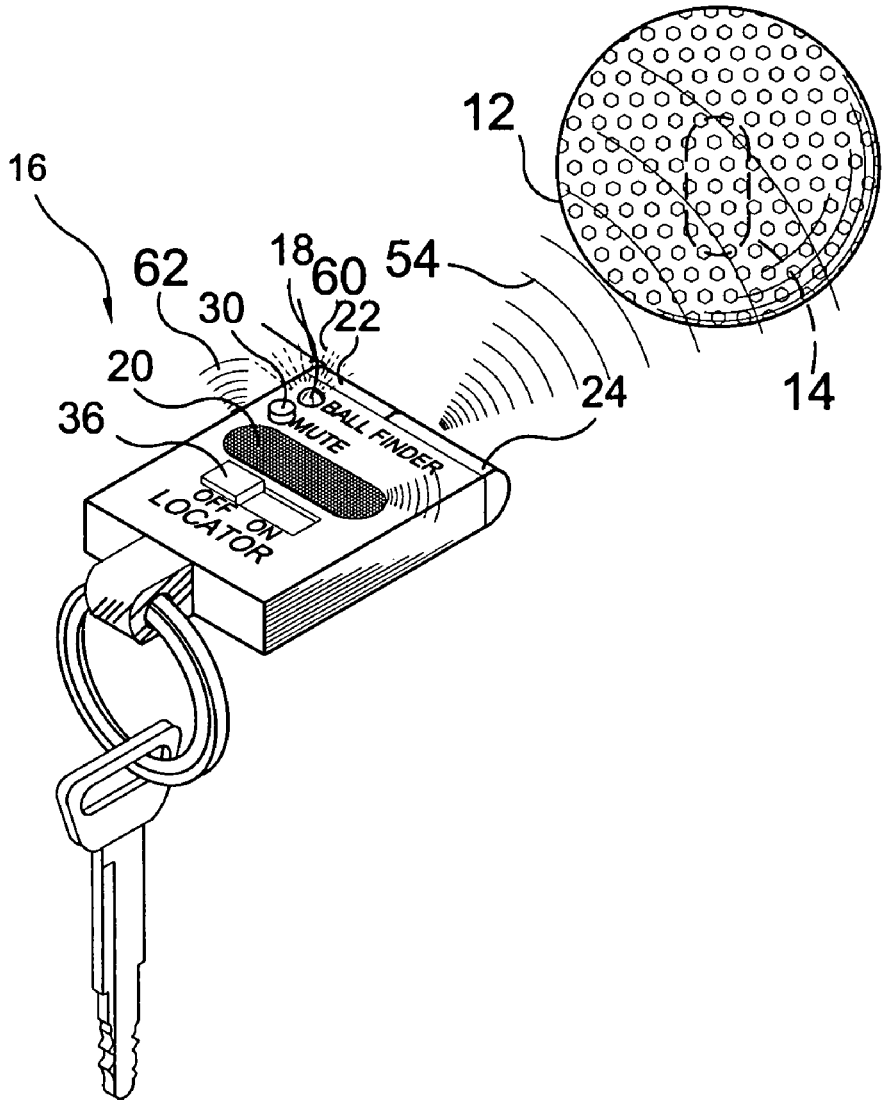
FIG. 3 is an illustrative view of the hand-held locator unit and golf ball of the present invention.

FIG. 3 is a perspective view of the hand-held unit 16 and golf ball 12 of the present invention. The unit 16 comprises the housing 26, the visual locator 18, the audible locator 20 and the mute button 30 for the audible locator 20 for when it might prove to be a distraction to others. Further included is a switch 36 to activate and deactivate the transmitter 14 and the receiver 22 that receives signals emitted by the passive transmitter 14 in the golf ball 12. When the hand-held unit 16 is activated by power switch 36, the unit transmitter 24 emits an activation signal 54 that is received by the passive transmitter 14 of the golf ball 12 thereby causing the passive transmitter 14 to emit a frequency modulated signal 15 as shown in FIG. 1, that is received by the receiver 22 of the hand-held unit 16. Upon receipt of the signal 15, the visual alert 18 is illuminated and the audio alert 20 emits. Alternatively, the audio alert will not emit a sound if the mute button 30 has been depressed.

Shown herein, the hand-held unit 16 is interacting with golf ball 12. The hand-held unit 16 has two ends. The first end of hand-held unit 16 includes a key ring. The second end of hand-held unit 16 comprises a hand-held unit transmitter 24 and a hand-held unit receiver 22. The hand-held unit 16 has a locator power switch 36 to activate and deactivate the passive transmitter 14 and the hand-held unit receiver 22 that accepts signals emitted by the passive transmitter 14 in golf ball 12. When the locator power switch 36 is in the "on" position, the hand-held unit transmitter 24 emits a signal 54 that is received by passive transmitter 14 of the golf ball 12. Passive transmitter 14 responds by emitting a frequency modulated signal 56 that is received by hand-held unit receiver 22. This signal causes the audio component 20 to emit a sound 62, provided the mute button 30 has not been depressed. The frequency modulated signal 56 also causes the visual component 18 to flash with increasing frequency as the hand-held unit 16 approaches golf ball 12.

Figure 4:
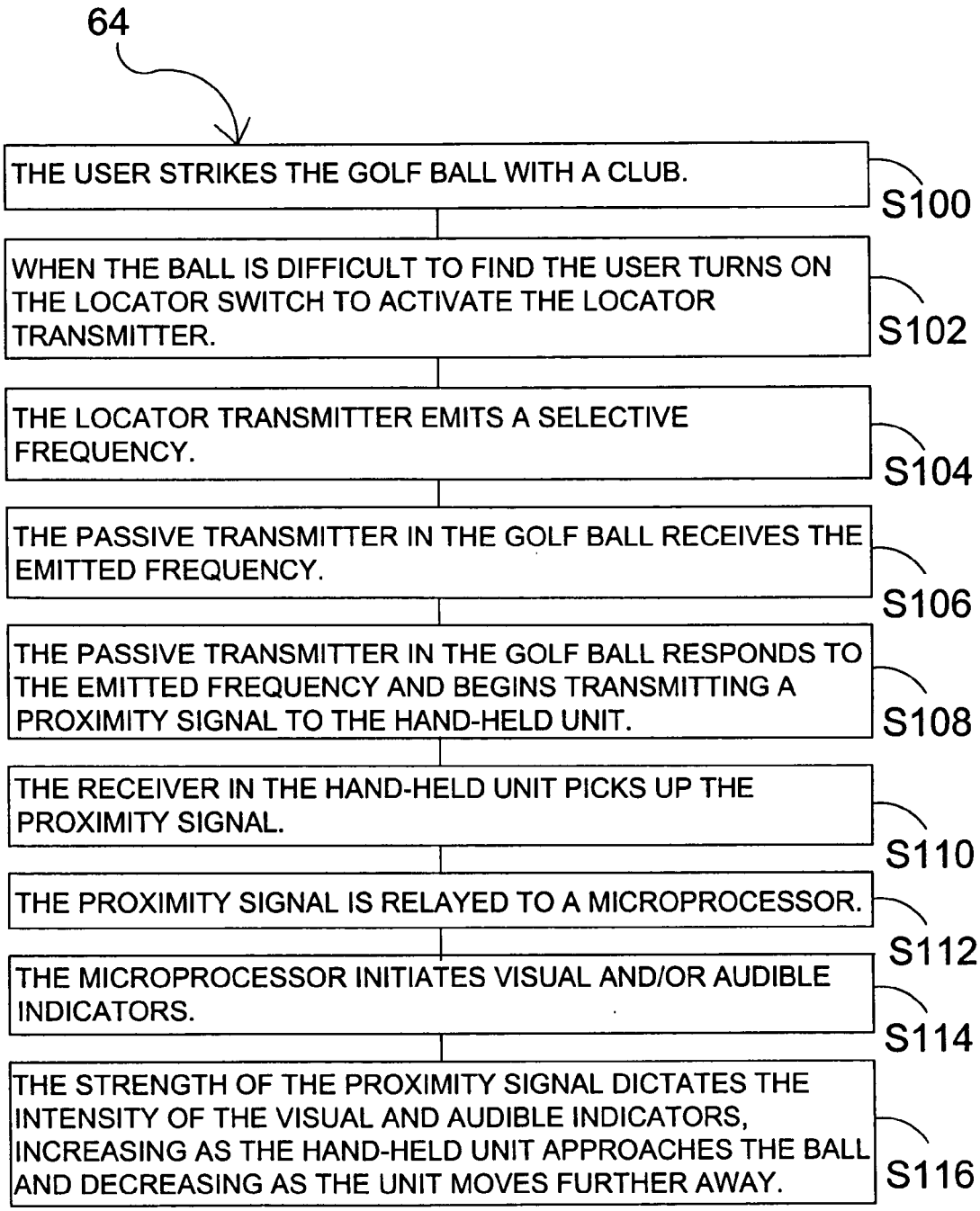
FIG. 4 is a block diagram of the present invention in use.

The method 64 of using the hand-held locator device 10 of the present invention is shown in FIG. 4. In step S100, the user strikes the ball with a club. Should the ball be difficult to locate, the user activates the locator on the hand held unit as in step S102. Upon activation of the locator, a transmitter emits an activation signal in step S104 which is received by the golf ball in step S106. Thereafter, in step S108, a passive transmitter positioned within the golf ball is activated and emits a proximity signal and in step S110 the handheld unit receives the proximity signal. The proximity signal is then provided to a processor in step S112 and the processor causes at least one of the audio and visual alerts to be activated as shown in step S114. Upon activation of the at least one of the audio and visual alerts, the microprocessor causes the alerts to intensify as the proximity signal becomes stronger due to the distance between the golfer and ball decreasing as shown in step S116.

Figure 5:
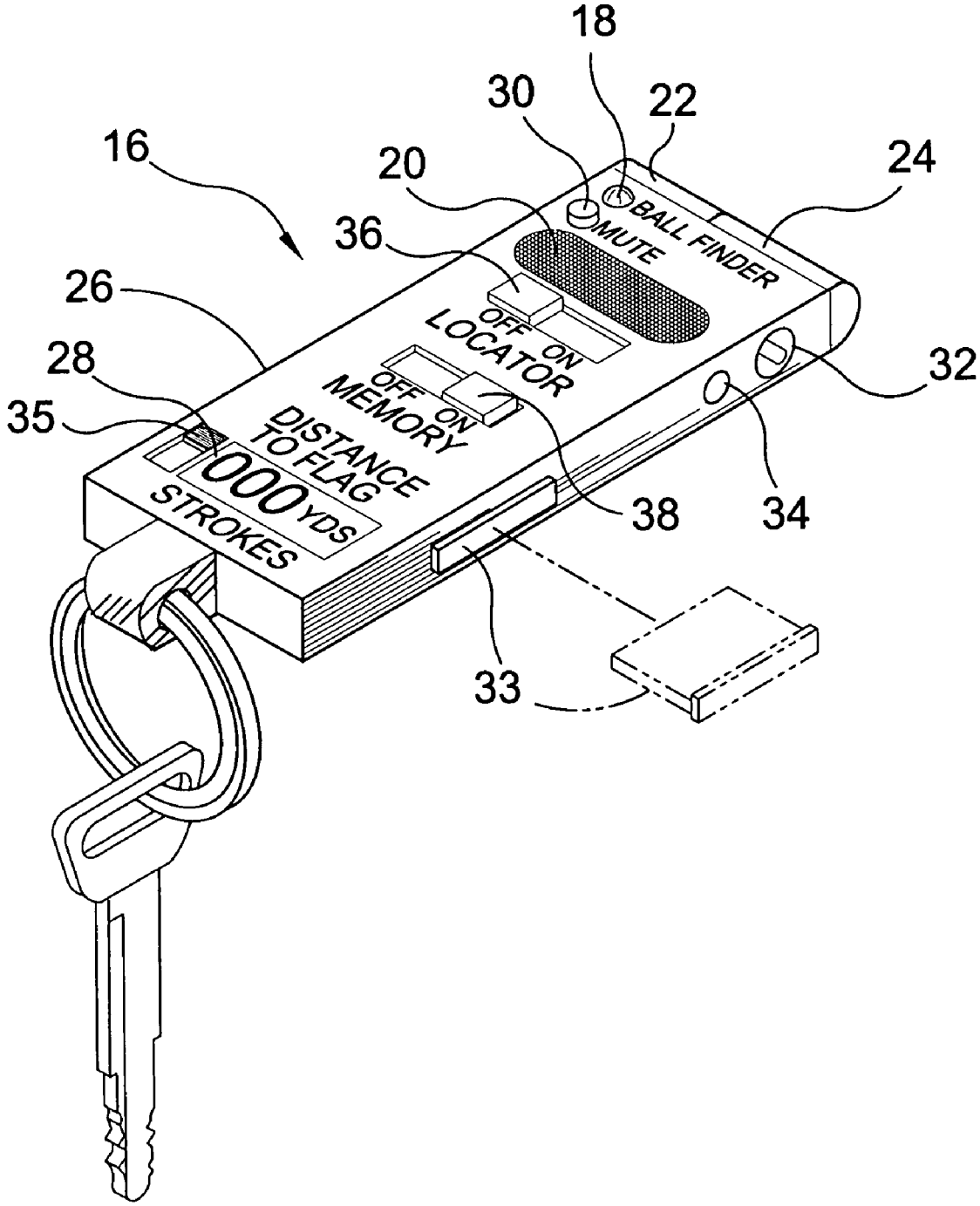
FIG. 5 is perspective view of the hand-held locator unit of the present invention having additional elements.

FIG. 5 is the hand-held locator unit 16 of the present invention having additional elements. The unit 16 comprises a housing 26, a visual locator 18, an audible locator 20 and a mute button 30 for the audible locator 20 for when it might prove to be a distraction to others. Further included is a switch 36 to activate and deactivate the transmitter 14 and the receiver 22 that accepts signals emitted by the passive chip 14 in the golf ball 12. When the hand-held unit 12 is activated by power switch 36, the unit transmitter 24 emits a signal 54 that is received by the passive transmitter 14 of the golf ball 12 thereby causing the passive transmitter 14 to emit a frequency modulated signal 56 that is received by the receiver 22 of the hand-held unit 16 causing the visual component 18 to be illuminated and the audio component 20 to emit a sound if the mute button 30 has not been depressed. The memory tracks and scores the amount of strokes taken during a round of golf and activating the yardage display transfer switch 35 will display the current stroke count in the yardage display 28.

The hand-held unit 16 includes the housing 26. The first end of housing 26 includes the key ring. The second end of housing 26 comprises the hand-held unit transmitter 24 and the hand-held unit receiver 22. The hand-held unit 16 has the locator power switch 36 to activate and deactivate the passive transmitter 14 and the hand-held unit receiver 22 for receiving signals emitted by the passive transmitter 14 in golf ball 12. Located on housing 26 is the visual alert 18, which increases the flashing frequency as the hand-held unit 16 approaches golf ball 12. Located on housing 26 is an audio component 20, which becomes louder as hand-held unit 16 approaches golf ball 12. The mute button 30 prevents the audio component 20 from making noise.

A memory switch 38 is in the "on" position, it tracks and scores the amount of strokes taken during a round of golf, the environmental conditions surrounding golf ball 12 for each stroke, and the golf club used for each stroke. To display the current stroke count in the yardage display 28, the yardage transfer switch 35 must be activated. The golfer 50, as shown in FIG. 1, can selectively download through a USB port 32 the golf course layout from an external source such as the internet. The hand-held unit 16 has a logic means whereby it can use the course layout and golf ball 12 location from GPS to calculate the distance from the golf ball 12 to the cup. The yardage display 28 shows the yards from the golf ball's current position to the hole, provided the yardage transfer switch 35 is not activated. The hand-held unit 16 also has a club display 76 for indicating which club should be used in the current conditions. The success rate of using that club is displayed in success rate display 78. The hand-held unit 16 also has a charging port 34 to recharge hand-held unit 16.

Additionally, the hand-held unit 16 has logic means for receiving geographic information from the GPS system that it uses to calculate the yardage to the hole and records the information for later downloading through USB port 32 or the removable memory card 33 to other computer components.

Figure 6:
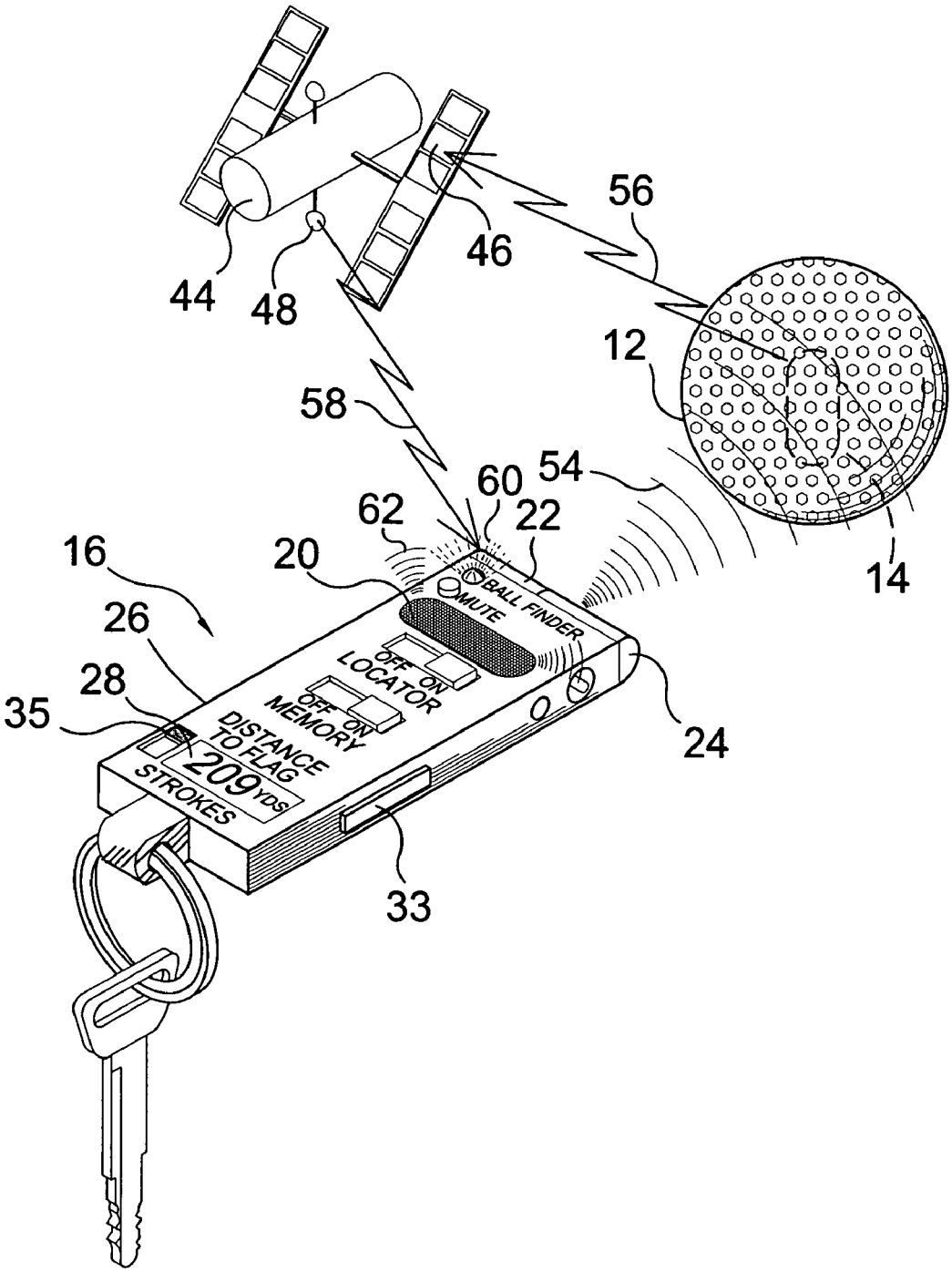
FIG. 6 is an illustrative view of the hand-held locator unit and golf ball of the present invention interacting with a global positioning satellite.

FIG. 6 is the hand-held locator unit 16 of the present invention having additional elements. The unit 16 comprises a housing 26, a visual locator 18, an audible locator 20 and a mute button 30 for the audible locator 20 for when it might prove to be a distraction to others. Further included is a switch 36 to activate and deactivate the transmitter 14 and the receiver 22 that accepts signals emitted by the passive chip 14 in the golf ball 12. When the hand-held unit 12 is activated by power switch 36, the unit transmitter 24 emits a signal 54 that is received by the passive transmitter 14 of the golf ball 12 thereby causing the passive transmitter 14 to emit a frequency modulated signal 56 that is received by the receiver 22 of the hand-held unit 16 causing the visual component 18 to be illuminated and the audio component 20 to emit a sound if the mute button 30 has not been depressed.

Additionally, the hand-held unit 16 has logic means for receiving geographic information 46 from the GPS system 44 whereby the hand-held unit 16 calculates the distance to the cup and displays the yardage on display 28. The GPS geographic information regarding the golf course being played has been downloaded into the hand-held unit 16 via USB port 32 from an external source such as the internet. The hand-held unit stores the course GPS geographic information that is used to calculate the current position of the ball 12 during play to the cup. By engaging the GPS record function at the tee, the number of strokes per hole can be calculated from the current position of the played ball and the cup, and the information can be downloaded to other computer apparatus for further processing. A removable memory card 33 is included to enhance the memory and ease for transferring data to other applications. The hand-held unit 16 keeps track of the amount of strokes taken since the beginning of the round and a yardage display transfer switch 35 allows the user to switch back and forth to view the stroke count or the yards to the cup on the yardage display 28 as desired.

Shown herein, the hand-held unit 16 is interacting with golf ball 12 and global positioning satellite 44. The hand-held unit 16 includes a housing 26. The housing 26 has two ends. The first end of housing 26 includes a key ring. The second end of housing 26 comprises a hand-held unit transmitter 24 and a hand-held unit receiver 22. The hand-held unit 16 has a locator power switch 36 to activate and deactivate the passive transmitter 14 and the hand-held unit receiver 22 that accepts signals emitted by the passive transmitter 14 in golf ball 12. When the locator power switch 36 is in the "on" position, the hand-held unit transmitter 24 emits a signal 54 that is received by passive transmitter 14 of the golf ball 12. Passive transmitter 14 responds by emitting a frequency modulated signal 56 that is received by hand-held receiver 22. This signal causes the audio component 20 to emit a sound 62, provided the mute button 30 has not been depressed. The frequency modulated signal 56 also causes the visual component 18 to flash with increasing frequency as the hand-held unit 16 approaches golf ball 12. Additionally, when the locator power switch 36 is in the "on" position, the passive transmitter 14 in golf ball 12 sends a signal 56 to the geographic information receiver 46 on global positioning satellite 44. The global positioning satellite's transmitter 48, in turn, sends the geographic information 58 to the hand-held unit 16. The golfer 50 (shown in FIG. 1) can selectively download through the USB port 32 the golf course layout from an external source such as the internet. The hand-held unit 16 has a logic means whereby it can use the course layout and golf ball 12 location from GPS to calculate the distance from the golf ball 12 to the cup. The yardage display 28 shows the yards from the golf ball's current position to the hole, provided the yardage transfer switch 35 is not activated. To display the current stroke count in the yardage display 28, the yardage transfer switch 35 must be activated. The hand-held unit 16 also has a club display 76 for indicating which club should be used in the current conditions and the success rate of using that club is displayed in success rate display 78. The hand-held unit 16 also has a charging port 34 to recharge hand-held unit 16. When the memory switch 38 is in the "on" position, it tracks and scores the amount of strokes taken during a round of golf, the environmental conditions surrounding golf ball 12 for each stroke, and the golf club used for each stroke. A removable memory card 33 is included to enhance the memory and ease for transferring data to other applications.

Figure 7:
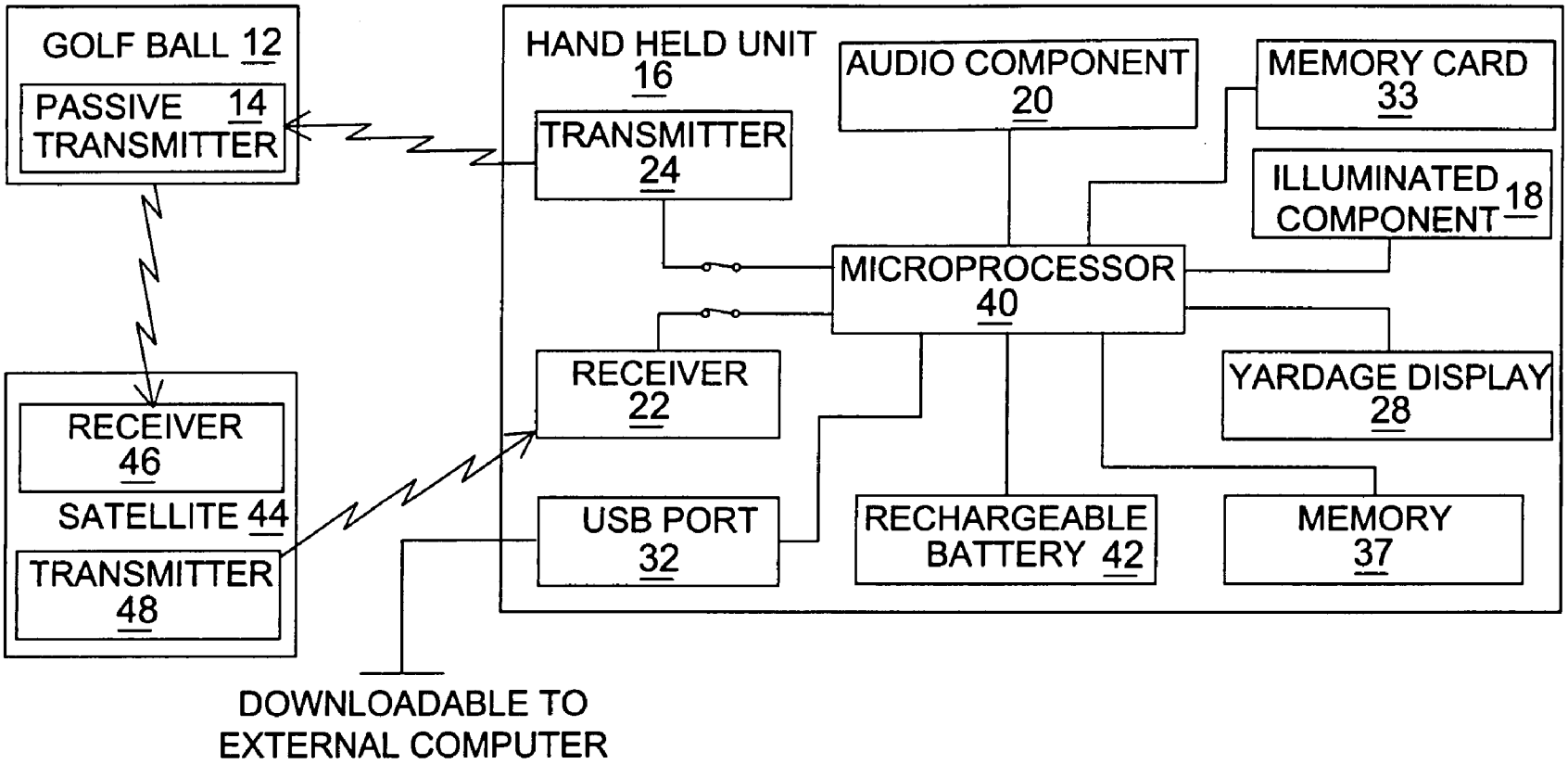
FIG. 7 is a flow chart of the operation of the locator function of the present invention.

FIG. 7 is a schematic diagram of the component of the present invention having additional elements. The golf ball 12 has passive transmitter 14 whereby the golf ball 12 can be located using the hand-held unit 16. The hand-held unit 16 has a microprocessor 40 and power source 42 whereby a transmission can be initiated through hand-held unit transmitter 24 that will elicit a transmission from the golf ball 12 passive transmitter 14 that will be received by the hand-held unit receiver 22. The microprocessor 40 will cause the visual component 18 and/or audio component 20 to be energized.

Additionally, the hand-held unit can have additional elements for receiving from the global positioning unit geographic information 58 that will be stored in the hand-held unit memory 37 that can be manipulated to display, via hand-held unit display 28, the remaining yardage to each hole of a predetermined golf course having GPS geographic information that has previously been download to the hand-held unit 16 through USB port 32. The GPS geographic information and strokes per hole that is stored in hand-held unit memory 37 can be downloaded to other computer components for further processing.

Figure 8:
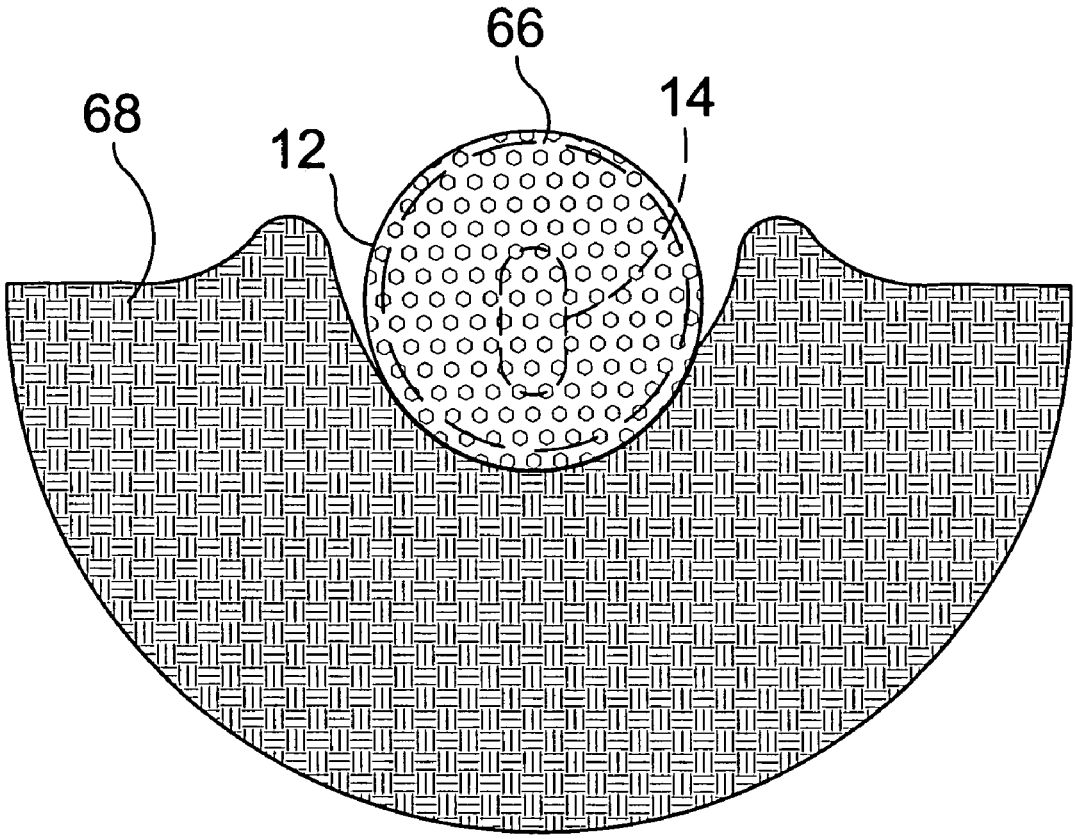
FIG. 8 is an illustrative view of the golf ball of the present invention including a passive transmitter and a pressure sensor.

FIG. 8 is an illustrative view of the golf ball 12 of the present invention including a passive transmitter 14 whereby the golf ball 12 can be located using the hand held unit 16. The golf ball 12 further includes a pressure sensor 66. The pressure sensor 66 selectively senses a pressure exerted by the ground on the golf ball 12. The sensed pressure is then transmitted 70 back to a central processor 72. Upon receiving the sensed pressure value, the processor 72 compares the value to a list of known pressure values stored in a memory unit. The known pressure values correspond to at least one of dry sand, wet sand, water, dry dirt, mud, grass, high grass, low grass, wet grass, and dry grass. When the processor 72 determines that the sensed pressure matches a known pressure value within a certain acceptable margin of error, the processor 72 stores this information and can provide the information to at least one of the golfer and additional golfers located at different locations throughout the course.

Figure 9:
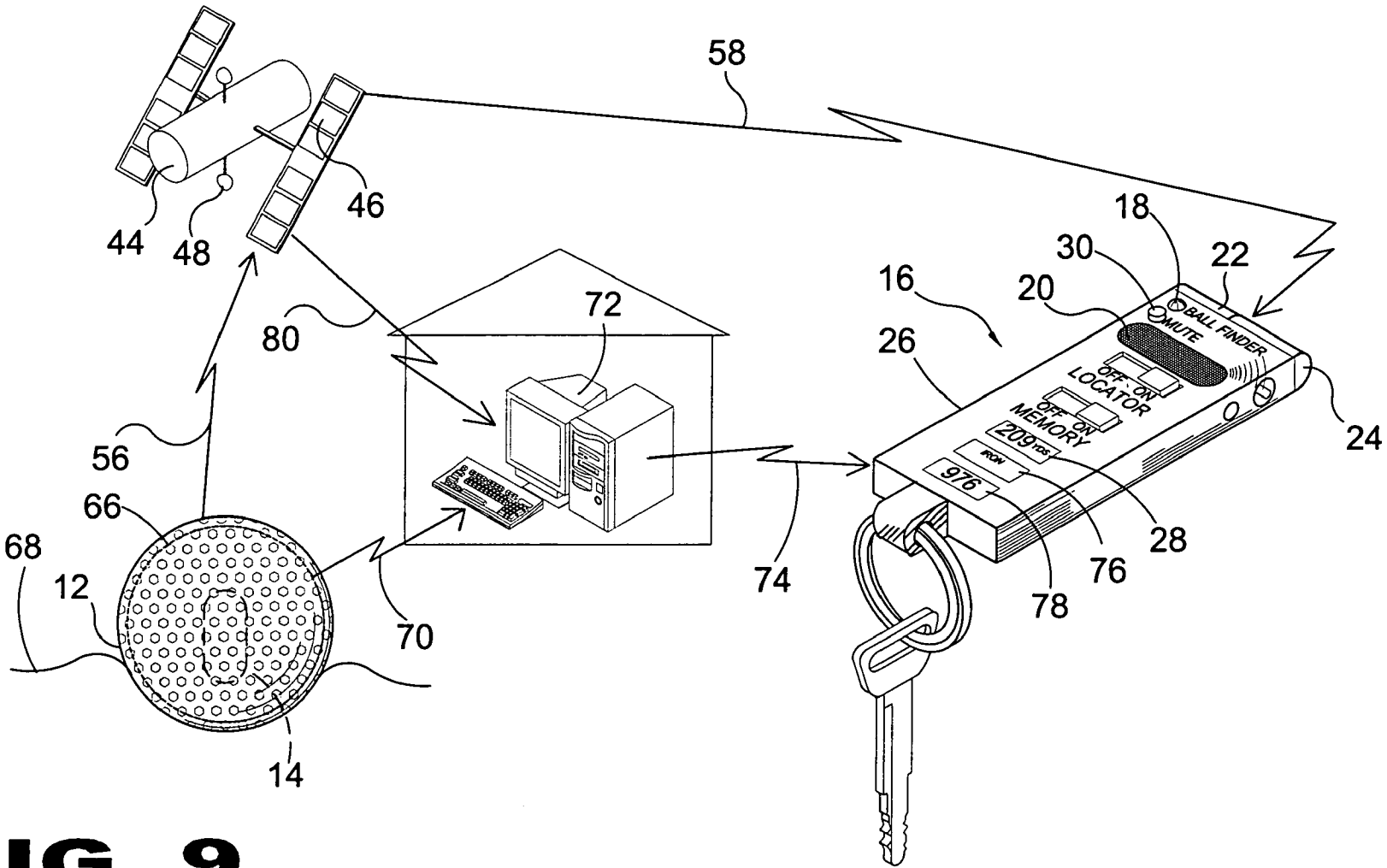
FIG. 9 is an illustrative view of the golf ball of the present invention interacting with the central processor and the global positioning satellite, both of which then interact with the hand held locator unit.

FIG. 9 is an illustrative view of the golf ball 12 of the present invention interacting with the central processor 72 and the global positioning satellite 44, both of which then interact with the hand held unit 16. When the ball is hit into play and lands, the pressure sensor senses the pressure surrounding the ball, such as the pressure exerted on the golf ball 12. A signal 70, including data representing the sensed pressure, is transmitted 70 to the processor 72 which upon receiving the sensed pressure value, the processor 72 compares the value to a list of known pressure values stored in a memory unit. The known pressure values correspond to at least one of dry sand, wet sand, water, dry dirt, mud, grass, high grass, low grass, wet grass, and dry grass. When the processor 72 determines that the sensed pressure matches a known pressure value within a certain acceptable margin of error, the processor 72 stores this information and can provide the information to at least one of the golfer and additional golfers located at different locations throughout the course. After landing, a geographic information receiver 46 in the global positioning satellite 44 receives the frequency modulated signal 56 from the passive transmitter 14. This geographic information is transmitted to both the central processor 72 via signal 80 and to the hand-held unit 16 via signal 58. The central processor 72 compiles the location and pressure information and transmits 74 this information to the hand held unit 16. The hand-held unit 16 then indicates to the player what type of club he used in previous similar conditions and the success rate of using that club. If the golfer does not want the compiled data, and just wants the golf ball 12 location, this information is transmitted 58 to the hand-held unit 16 from the global positioning satellite 44.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Apparatus for locating a golf ball during play of a golf game comprising:

a) a golf ball having a passive transmitter and means for sensing environmental conditions positioned therein;

b) means for determining and providing a location of said golf ball;

c) a hand-held unit comprising means for enabling at least one of the passive transmitter and the environmental sensing means contained within the golf ball;

d) a receiver contained within said hand-held unit for receiving a location signal from said determining and providing means; and e) means positioned on said hand-held unit for indicating to a golfer said location of said golf ball, wherein upon said location being indicated, said environmental sensing means is able to selectively determine conditions corresponding to said location and provide said conditions to said hand-held unit for further indication to said golfer;

wherein said environmental sensing means selectively determines said conditions by sensing a pressure value exerted by a surface on said golf ball, and wherein said hand-held unit further comprises a processor for comparing the sensed pressure value with a known pressure value corresponding to a plurality of surfaces.

2. The apparatus as recited in claim 1, wherein said surface is at least one of mud, dirt, wet sand, dry sand, dry grass, wet grass, water.

3. The apparatus as recited in claim 2, wherein said plurality of surfaces is at least one of mud, dirt, wet sand, dry sand, dry grass, wet grass, water.

4. The apparatus as recited in claim 3, wherein said environment sensing means is further able to sense a type of club used to strike said golf ball.

5. The apparatus as recited in claim 4, further comprising means for compiling and providing information to at least one said golfer and a subsequent golfer that is not in an immediate proximity of said golfer.

6. The apparatus as recited in claim 5, wherein said information compiled by said compiling and providing means includes at least one of a weather condition, said location, said conditions, and said type of golf club.

7. The apparatus as recited in claim 6, wherein upon said information being provided to said golfer by said compiling and providing means, said golfer is able to analyze prior actions taken while playing a respective hole on a golf course.

8. The apparatus as recited in claim 6, wherein upon said information being provided to said golfer by said compiling and providing means, said golfer is able to at least one of transmit and store said information for later analysis and use.

9. The apparatus as recited in claim 6, wherein upon said information being provided to said subsequent golfer by said compiling and providing means, said subsequent golfer is alerted to said conditions and is able to selectively adjust the play on said course.

10. The apparatus as recited in claim 1, wherein the means for enabling the passive transmitter includes a transmitter for generating an electromagnetic wave for energizing said passive transmitter to emit a modulated frequency signal.

11. The apparatus as recited in claim 10, wherein the indicating means includes a receiver for receiving the said modulated frequency signal.

12. The apparatus as recited in claim 11, wherein said indicating means is a visual indicator that flashes upon said hand-held unit receiving said modulated frequency signal from said golf ball.

13. The apparatus as recited in claim 12, wherein said visual indicator is caused to flash at a greater frequency upon a determination by said determining and providing means that a distance between said golfer and said golf ball is decreasing.

14. The apparatus as recited in claim 11, wherein said indicating means is an audible indicator that emits a sound when said hand-held unit receives said modulated frequency signal from said golf ball.

15. The apparatus as recited in claim 14, wherein a volume of said sound increases upon a determination by said determining and providing means that a distance between said golfer and said golf ball is decreasing.

16. The apparatus as recited in claim 14, wherein the hand-held unit has a switch for muting the audible indicator.

17. The apparatus as recited in claim 1, further comprising a memory unit for storing said location and said conditions therein.

18. The apparatus as recited in claim 1, wherein said indicating means is a LCD display.

* * * * *